US009534467B2

(12) United States Patent
Rhodes et al.

(10) Patent No.: US 9,534,467 B2
(45) Date of Patent: Jan. 3, 2017

(54) CONNECTOR APPARATUS FOR SUBSEA BLOWOUT PREVENTER

(71) Applicant: Seaboard International, Inc., Houston, TX (US)

(72) Inventors: Jerry Keith Rhodes, Pearland, TX (US); Kenneth Bean, Pearland, TX (US); Paul Horton, Jr., Lafayette, LA (US)

(73) Assignee: SEABOARD INTERNATIONAL, INC., Houston, TX (US)

( * ) Notice: Subject to any disclaimer, the term of this patent is extended or adjusted under 35 U.S.C. 154(b) by 0 days.

(21) Appl. No.: 14/870,501

(22) Filed: Sep. 30, 2015

(65) Prior Publication Data

US 2016/0017682 A1 Jan. 21, 2016

Related U.S. Application Data

(63) Continuation of application No. 14/095,241, filed on Dec. 3, 2013, now Pat. No. 9,175,551.

(60) Provisional application No. 61/733,039, filed on Dec. 4, 2012.

(51) Int. Cl.

| | |
|---|---|
| ***E21B 43/01*** | (2006.01) |
| ***E21B 33/038*** | (2006.01) |
| ***E21B 33/064*** | (2006.01) |

(52) U.S. Cl.

CPC ..... *E21B 33/038* (2013.01); *E21B 33/064* (2013.01); *E21B 43/0122* (2013.01)

(58) Field of Classification Search

CPC ..... E21B 33/03; E21B 33/06; E21B 33/064; E21B 33/035; E21B 33/043

USPC ..... 166/363, 85.1, 85.4, 85.5, 360, 368

See application file for complete search history.

(56) References Cited

U.S. PATENT DOCUMENTS

| | | | | |
|---|---|---|---|---|
| 3,290,063 | A | 12/1966 | Haeber | |
| 4,084,842 | A | 4/1978 | Stonitsch et al. | |
| 5,860,478 | A * | 1/1999 | Coutts | E21B 34/045 166/356 |
| 6,070,669 | A | 6/2000 | Radi et al. | |
| 6,241,015 | B1 | 6/2001 | Pringle et al. | |
| 6,321,846 | B1 | 11/2001 | Rytlewski | |

(Continued)

OTHER PUBLICATIONS

Supplementary European Search Report and Written Opinion for EP Application No. EP 13861377 prepared by the European Patent Office, mailed Oct. 13, 2016, 7 pages.

*Primary Examiner* — Matthew R Buck
*Assistant Examiner* — Patrick Lambe
(74) *Attorney, Agent, or Firm* — Haynes and Boone LLP

(57) ABSTRACT

According to one aspect, an apparatus is adapted to be operably coupled to a subsea blowout preventer and includes a first tubular member defining an internal passage, and a second tubular member extending within the internal passage. A sealing assembly is disposed radially between the first and second tubular members, and includes a sealing element. The second tubular member covers the sealing element and thus facilitates protecting the sealing element from any fluid flow through the internal passage. According to another aspect, a sealing element of a connector is protected before engaging the connector with a subsea casing. The connector is engaged with the casing while the sealing element is protected so that the sealing element is fluidically isolated from any fluid flow through the connector. The sealing element sealingly engages the casing.

18 Claims, 6 Drawing Sheets

(56) References Cited

U.S. PATENT DOCUMENTS

| | | | |
|---|---|---|---|
| 6,336,508 | B1 | 1/2002 | Guinn |
| 7,240,735 | B2 | 7/2007 | Crozier |
| 7,909,110 | B2 | 3/2011 | Sharma et al. |
| 8,136,598 | B2 | 3/2012 | Kotrla et al. |
| 2009/0090515 | A1 | 4/2009 | Chan |
| 2010/0300700 | A1 | 12/2010 | Garbett et al. |
| 2012/0199360 | A1 | 8/2012 | Kotrla et al. |

* cited by examiner

CONNECTOR APPARATUS FOR SUBSEA BLOWOUT PREVENTER

CROSS-REFERENCE TO RELATED APPLICATION

This application is a continuation of U.S. application Ser. No. 14/095,241, filed Dec. 3, 2013, which claims the benefit of the filing date of, and priority to, U.S. patent application Ser. No. 61/733,039, filed Dec. 4, 2012, the entire disclosures of which are hereby incorporated herein by reference.

TECHNICAL FIELD

This disclosure relates in general to subsea oil and gas exploration and production operations and, in particular, to improved apparatus and methods for sealingly engaging subsea casings during emergency situations such as, for example, situations involving containing wellbore blowouts.

BACKGROUND OF THE DISCLOSURE

Several systems are used to facilitate subsea oil and gas exploration and production operations. Examples include certain types of subsea blowout preventers (BOPs), which can seal off wellbores to prevent wellbore blowouts, that is, uncontrolled releases of oil and gas from the wellbores. In some cases, before, during or after a blowout prevention operation involving a producing well, an emergency wellhead connector is engaged with a subsea casing of the producing well in order to sealingly engage the subsea casing. However, the sealing elements of the connector used to effect such a sealing engagement may possibly be damaged by flowing wellbore fluids or produced fluids, decreasing the efficacy of the sealing engagement. Also, it is sometimes difficult to monitor or control the complete engagement of the connector with the subsea casing. Therefore, what is needed is an apparatus or method that addresses one or more of the foregoing issues, among others.

SUMMARY

In a first aspect, there is provided an apparatus adapted to be operably coupled to a subsea blowout preventer, the apparatus including a first tubular member defining a first internal passage adapted to receive a casing, the first tubular member including axially opposing first and second end portions, and a first internal shoulder positioned axially between the first and second end portions; a counterbore formed in the second end portion of the first tubular member and coaxial with the first internal passage, wherein the first internal shoulder of the first tubular member is defined by the counterbore; a sealing assembly disposed in the counterbore, the sealing assembly including a sealing element; and a second tubular member defining a second internal passage, the second tubular member extending within the first internal passage. The second tubular member has a first axial position, relative to the first tubular member, in which the second tubular member covers the sealing element and thus facilitates protecting the sealing element from any fluid flow through the first internal passage. The second tubular member has a second axial position, relative to the first tubular member, in which the second tubular member does not cover the sealing element.

In certain exemplary embodiments, the second tubular member moves, relative to the first tubular member, from the first axial position to the second axial position as the casing is received by the first internal passage.

In another exemplary embodiment, the first tubular member includes a second internal shoulder positioned axially between the first end portion and the first internal shoulder; and wherein, when the second tubular member is in the second axial position, the second tubular member abuts the second internal shoulder of the first tubular member.

In certain exemplary embodiments, the sealing assembly defines a first axial length; and wherein the second tubular member defines a second axial length that is equal to, or greater than, the first axial length.

In an exemplary embodiment, the apparatus includes a shear element engaged with each of the first and second tubular members; wherein, when the second tubular member is in the first axial position, the shear element resists relative movement between the first and second tubular members.

In another exemplary embodiment, the first end portion of the first tubular member is adapted to be connected to the subsea blowout preventer.

In an exemplary embodiment, the apparatus includes a third tubular member connected to the first tubular member at the second end portion thereof, the third tubular member defining a third internal passage that is coaxial with the first internal passage; and one or more casing slips at least partially disposed in the third internal passage.

In another exemplary embodiment, the sealing assembly abuts the first internal shoulder of the first tubular member; and wherein the sealing element is adapted to sealingly engage the casing after the casing has been received by the first internal passage.

In yet another exemplary embodiment, the apparatus includes a spacer disposed in the counterbore and abutting the sealing assembly; wherein the sealing assembly is positioned axially between the spacer and the first internal shoulder of the first tubular member.

In a second aspect, there is provided an apparatus adapted to be operably coupled to a subsea blowout preventer, the apparatus including a first tubular member defining a first internal passage, the first tubular member including axially opposing first and second end portions; a second tubular member defining a second internal passage, the second tubular member extending within the first internal passage; and a sealing assembly disposed radially between the first and second tubular members, the sealing assembly including a sealing element. The second tubular member covers the sealing element and thus facilitates protecting the sealing element from any fluid flow through the first internal passage. The second tubular member is slidable, within the first internal passage and relative to the first tubular member, so that the second tubular member does not cover the sealing element.

In an exemplary embodiment, the first internal passage is adapted to receive a casing; and wherein the first end portion of the first tubular member is adapted to be connected to the subsea blowout preventer.

In another exemplary embodiment, the first tubular member further includes a first internal shoulder positioned axially between the first and second end portions; wherein the apparatus further includes a counterbore formed in the second end portion of the first tubular member and coaxial with the first internal passage, wherein the first internal shoulder of the first tubular member is defined by the counterbore; and wherein the sealing assembly is disposed in the counterbore.

In yet another exemplary embodiment, the apparatus includes a spacer disposed in the counterbore and abutting the sealing assembly, wherein the sealing assembly is positioned axially between the spacer and the first internal shoulder of the first tubular member.

In an exemplary embodiment, the apparatus includes a shear element engaged with each of the first and second tubular members, wherein the shear element resists relative movement between the first and second tubular members.

In another exemplary embodiment, the apparatus includes a third tubular member connected to the first tubular member at the second end portion thereof, the third tubular member defining a third internal passage that is coaxial with the first internal passage; and one or more casing slips at least partially disposed in the third internal passage.

According to a third aspect, there is provided a method including providing a connector adapted to be operably coupled to a subsea blowout preventer; protecting a sealing element of the connector before engaging the connector with a subsea casing; engaging the connector with the subsea casing while continuing to protect the sealing element so that the sealing element is fluidically isolated from any fluid flow through the connector; continuing to engage the connector with the subsea casing while continuing to protect the sealing element until a positive stop for the subsea casing is achieved; and sealingly engaging the outside surface of the subsea casing with the sealing element.

In an exemplary embodiment, the subsea casing is part of a producing well and thus the sealing element is fluidically isolated from any flow of wellbore fluids or produced fluids through the connector during the engagement of the connector with the subsea casing.

In another exemplary embodiment, the connector includes a first tubular member that defines a first internal passage; and wherein protecting the sealing element before engaging the connector with the subsea casing includes positioning a second tubular member at a first position within the first internal passage so that the second tubular member covers the sealing element.

In yet another exemplary embodiment, engaging the connector with the subsea casing while continuing to protect the sealing element includes effecting relative movement between the connector and the subsea casing so that the first internal passage receives the subsea casing while the first position of the second tubular member is maintained.

In an exemplary embodiment, continuing to engage the connector with the subsea casing while continuing to protect the sealing element until the positive stop for the subsea casing is achieved includes continuing to receive the subsea casing within the first internal passage so that the subsea casing engages the second tubular member and forces the second tubular member to move, relative to the first tubular member, within the first internal passage and away from the sealing element so that the second tubular member does not cover the sealing element; wherein, during the relative movement between the first and second tubular members, the sealing element is covered by the second tubular member, the first tubular member, or both of the second and first tubular movements, to continue to protect the sealing element.

In another exemplary embodiment, the first internal passage continues to receive the subsea casing, while the sealing element continues to be protected, until a positive stop for the subsea casing is achieved.

In yet another exemplary embodiment, the connector includes a plurality of casing slips; and wherein the method further includes mechanically gripping the casing using the plurality of casing slips.

Other aspects, features, and advantages will become apparent from the following detailed description when taken in conjunction with the accompanying drawings, which are a part of this disclosure and which illustrate, by way of example, principles of the inventions disclosed.

DESCRIPTION OF FIGURES

The accompanying drawings facilitate an understanding of the various embodiments.

DETAILED DESCRIPTION

Figure 1:
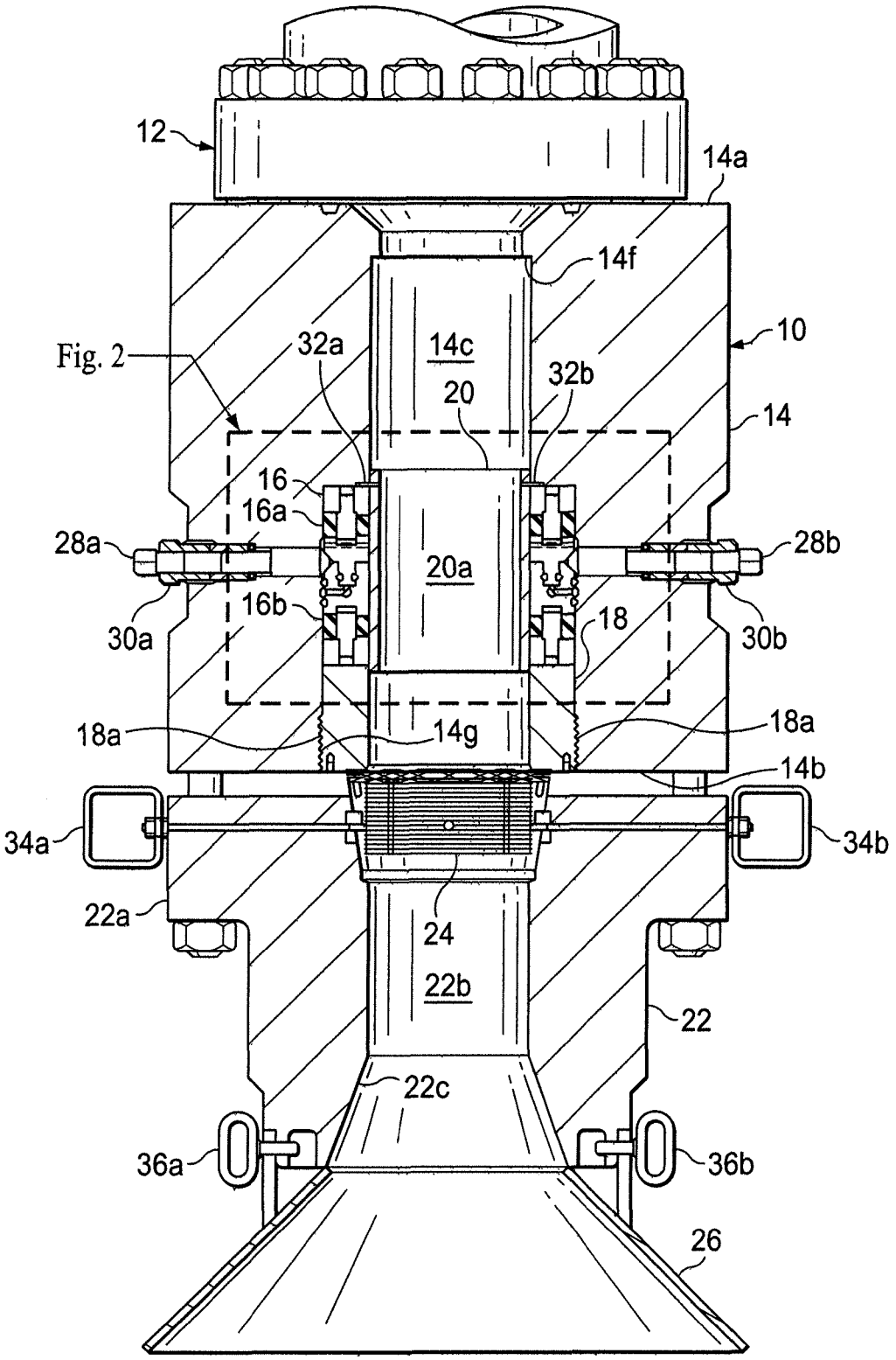
FIG. 1 is a sectional view of a connector apparatus adapted to be operably coupled to a subsea blowout preventer, according to an exemplary embodiment.

In an exemplary embodiment, as illustrated in FIG. 1, a connector apparatus is generally referred to by the reference numeral 10 and is adapted to be connected to a flanged connection 12. In an exemplary embodiment, the flanged connection 12 may be part of a subsea blowout preventer (BOP), and thus the connector apparatus 10 may be adapted to be operably coupled to a subsea blowout preventer. In an exemplary embodiment, the flanged connection 12 may be part of a BOP riser or marine drilling riser, which, in turn, may be operably coupled to a subsea blowout preventer; thus, the connector apparatus 10 may be adapted to be operably coupled to that subsea blowout preventer via at least the flanged connection 12. In several exemplary embodiments, instead of, or in addition to the flanged connection 12, the connector apparatus 10 may be operably coupled to a subsea blowout preventer via one or more other connections, such as one or more connections that extend radially from the adapter 14. In several exemplary embodiments, by being adapted to be coupled to a subsea blowout preventer, the connector apparatus 10, the flanged connection 12, or both, may be considered to be part of that subsea blowout preventer. In several exemplary embodiments, as will be described in further detail below, the connector apparatus 10 may be an emergency wellhead connector that is capable of engaging a subsea casing, and sealingly engaging same, before, during or after a blowout prevention operation involving a producing well.

The connector apparatus 10 includes a tubular member or adapter 14, a sealing assembly 16, a tubular member or spacer 18, a tubular member or sleeve 20, a tubular member or slip bowl 22, a plurality of casing slips 24, and a funnel 26.

Figure 2:
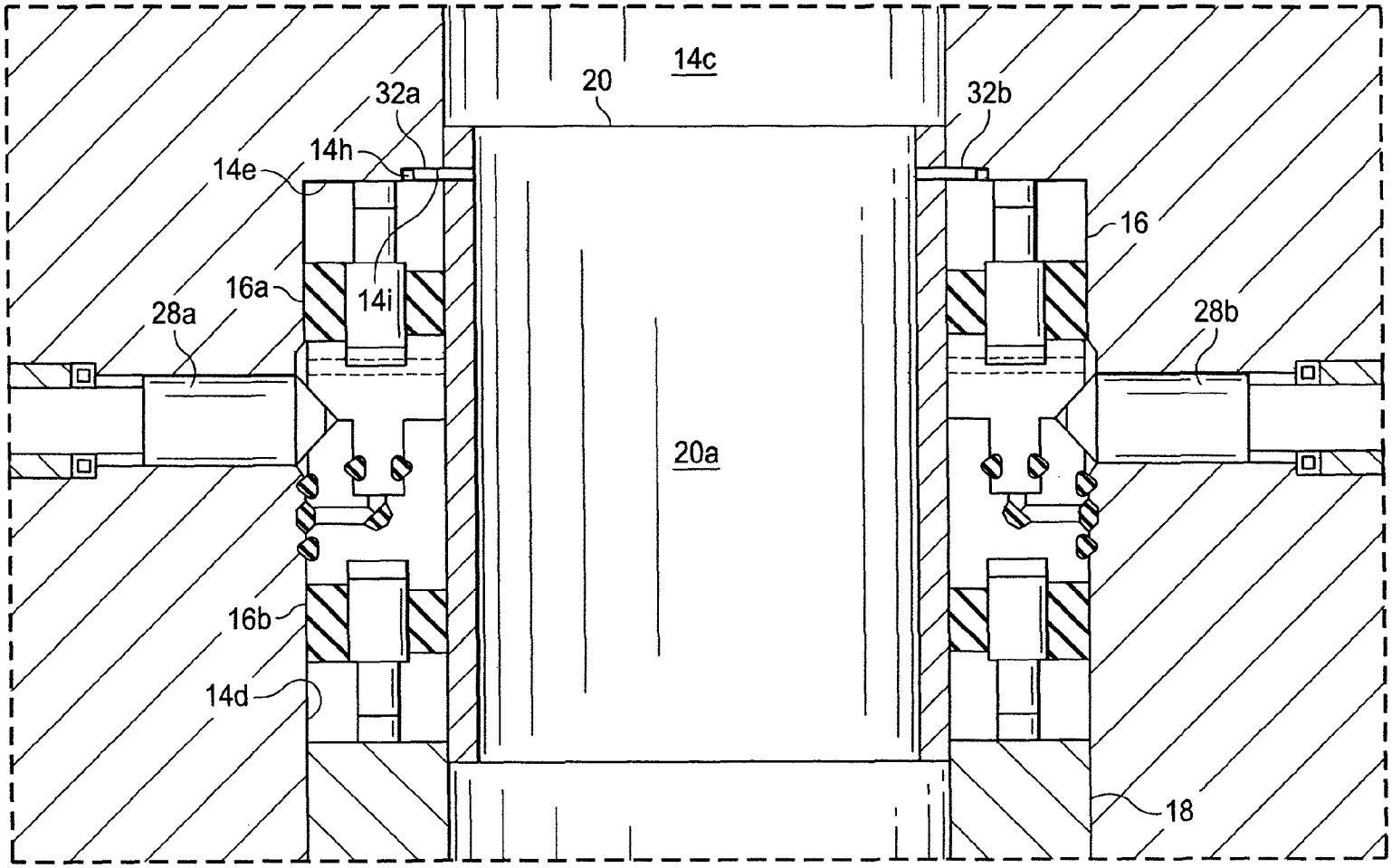
FIG. 2 is an enlarged view of a portion of FIG. 1, according to an exemplary embodiment.

In an exemplary embodiment, as illustrated in FIGS. 1 and 2, the adapter 14 includes axially opposing end portions 14*a* and 14*b*, and defines an internal passage 14*c*, which extends between the end portions 14*a* and 14*b* and through the adapter 14. A counterbore 14*d* is formed in the end portion 14*b*, extending upwardly as viewed in FIG. 1. The counterbore 14*d* is coaxial with the internal passage 14*c*. The adapter 14 further includes an internal shoulder 14*e*, which is defined by the counterbore 14*d* and positioned axially between the end portions 14*a* and 14*b*. An internal shoulder 14*f* is formed in the inside surface of the adapter 14, and is positioned axially between the end portion 14*a* and the internal shoulder 14*e*. An internal threaded connection 14*g* is formed in the inside surface of the adapter 14 at the end portion 14*b*. A recess 14*h* is formed in the internal shoulder 14*e*, defining an internal shoulder 14*i*.

The sealing assembly 16 is disposed in the counterbore 14*d*, and includes sealing elements 16*a* and 16*b*. In an exemplary embodiment, each of the sealing elements 16*a* and 16*b* includes one or more elastomer seals. Lock screws 28*a* and 28*b* extend radially inward through the adapter 14, from the outside surface of the adapter 14 and into the counterbore 14*d*, so that the respective distal ends of the lock screws 28*a* and 28*b* engage the sealing assembly 16. The lock screws 28*a* and 28*b* extend through gland nuts 30*a* and 30*b*, respectively. In an exemplary embodiment, under conditions to be described below, the sealing elements 16*a* and 16*b* are adapted to be pressure set, as well as mechanically set. In several exemplary embodiments, instead of, or in addition to being adapted to be both pressure and mechanically set, the sealing elements 16*a* and 16*b* may be adapted to be pressure set, mechanically set, interference set, or to be set using any combination of the foregoing. The upper end of the sealing assembly 16 abuts the internal shoulder 14*e*. In several exemplary embodiments, depending upon the type of sealing system selected for the sealing assembly 16, the lock screws 28*a* and 28*b* and the gland nuts 30*a* and 30*b* may be omitted.

As shown in FIGS. 1 and 2, the spacer 18 is disposed in the counterbore 14*d* so that the spacer 18 abuts the lower end of the sealing assembly 16. The spacer 18 is connected to the adapter 14. In an exemplary embodiment, the spacer 18 includes an external threaded connection 18*a*, which is threadably engaged with the internal threaded connection 14*g*, thereby connection the spacer 18 to the adapter 14. As a result, the sealing assembly 16 is locked, or captured, between the spacer 18 and the internal shoulder 14*e* of the adapter 14.

The sleeve 20 defines an internal passage 20*a*, and extends within the internal passage 14*c* of the adapter 14 so that the sealing assembly 16 is disposed radially between the adapter 14 and the sleeve 20. As shown in FIGS. 1 and 2, the sleeve 20 has an axial position in which the sleeve 20 covers the sealing elements 16*a* and 16*b*, thereby facilitating the protection of the sealing elements 16*a* and 16*b* from any fluid flow through the internal passage 14*c*, as will be discussed in further detail below. The axial length of the sleeve 20 is greater than the axial length of the sealing assembly 16, thereby ensuring that the sleeve 20 covers the sealing elements 16*a* and 16*b* when the sleeve 20 is in the axial position shown in FIGS. 1 and 2. In an exemplary embodiment, the respective axial lengths of the sleeve 20 and the sealing assembly 16 may be equal. Under conditions to be described below, the sleeve 20 is adapted to move or slide within the internal passage 14*c* of the adapter 14.

Shear elements 32*a* and 32*b* engage each of the sleeve 20 and the adapter 14. The shear elements 32*a* and 32*b* resist relative movement between the sleeve 20 and the adapter 14, thereby maintaining the position of the sleeve 20 shown in FIGS. 1 and 2. In an exemplary embodiment, the shear elements 32*a* and 32*b* extend radially through the sleeve 20 and into the recess 14*h*. As a result, the shear elements 32*a* and 32*b* are captured between the internal shoulder 14*i* and the upper end of the sealing assembly 16 that abuts the internal shoulder 14*e*. In several exemplary embodiments, the shear elements 32*a* and 32*b* may be shear pins, shear fasteners, or any combination thereof.

As shown in FIG. 1, the slip bowl 22 includes an upper flange connection 22*a*, which is connected to the end portion 14*b* of the adapter 14, thereby connecting the slip bowl 22 to the adapter 14. An internal passage 22*b* is defined by the slip bowl 22, and is coaxial with the internal passage 14*c* of the adapter 14. A frusto-conical surface 22*c* is defined by the internal passage 22*b*.

The casing slips 24 are at least partially disposed in the internal passage 22*b* of the slip bowl 22. As shown in FIG. 1, at least a portion of the casing slips 24 are positioned axially between the end portion 14*b* of the adapter 14 and the upper flange connection 22*a* of the slip bowl 22. The position of the casing slips 24 are maintained, at least in part, by retention screws 34*a* and 34*b*. The retention screws 34*a* and 34*b* extend radially through the upper flanged connection 22*a* of the slip bowl 22, from the outside surface of the upper flanged connection 22*a* and into the internal passage 22*b*, so that the respective distal ends of the retention screws 34*a* and 34*b* engage the casing slips 24.

The funnel 26 is connected to the slip bowl 22 at the end portion thereof opposite the upper flanged connection 22*a*. In an exemplary embodiment, the funnel 26 is connected to the slip bowl 22 via fasteners, such as pins 36*a* and 36*b*. In an exemplary embodiment, the pins 36*a* and 36*b* are quick-release pins.

Figure 3:
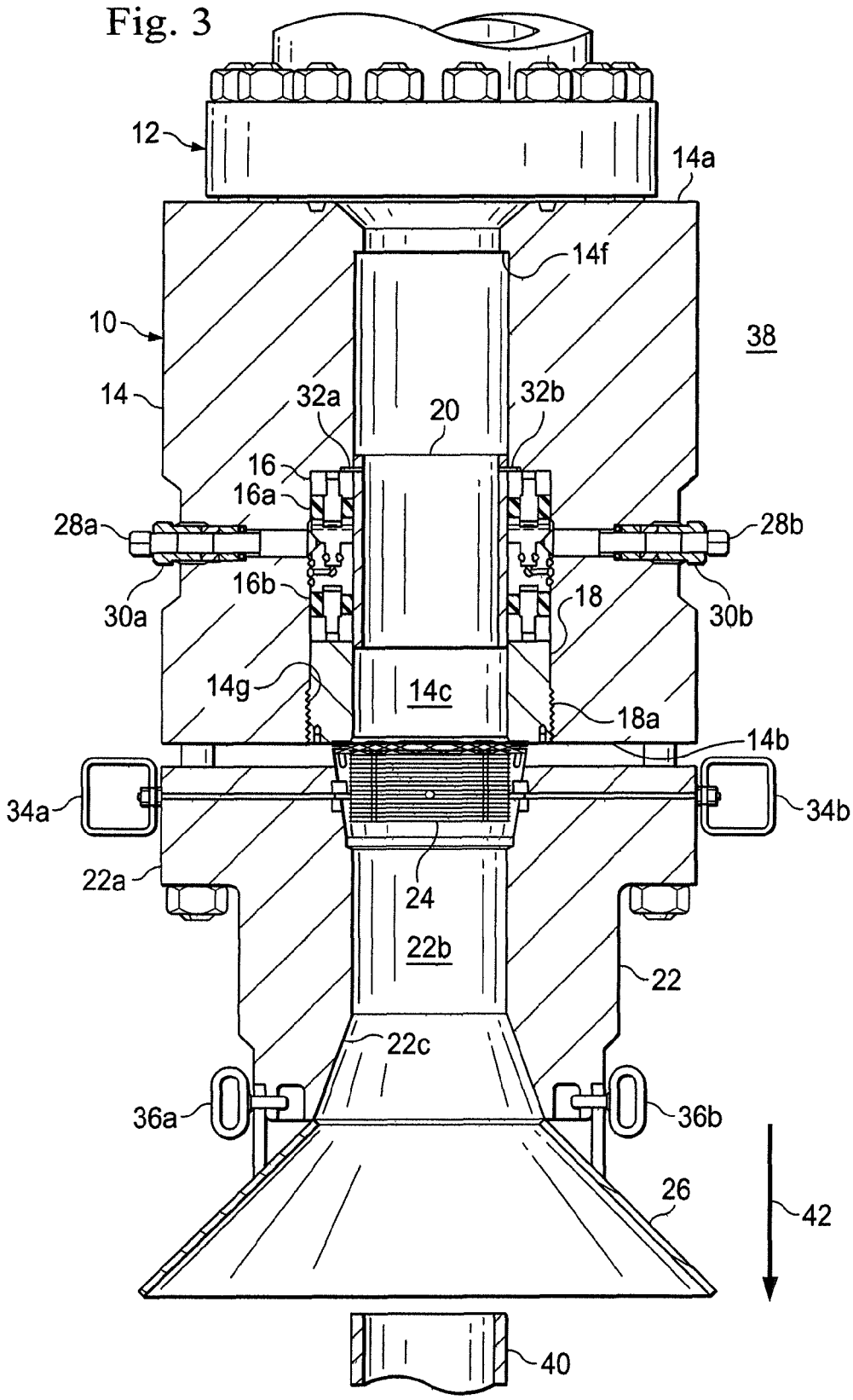
FIG. 3 is a sectional view of an engagement operation between the connector apparatus of FIGS. 1 and 2 and a casing, according to an exemplary embodiment.

In operation, in an exemplary embodiment, as illustrated in FIG. 3 with continuing reference to FIGS. 1 and 2, the connector apparatus 10 is lowered in an ocean or sea 38 and towards a subsea casing 40, which extends from the seabed and past a mudline (not shown). Below the mudline, the casing 40 extends within a wellbore (not shown), which traverses one or more subterranean formations below the seabed. The casing 40 is used in oil and gas exploration and production operations, and may be part of a producing well. The connector apparatus 10 is lowered in a direction indicated by an arrow 42 in FIG. 3. In an exemplary embodiment, the flanged connection 12 may be lowered along with the connector apparatus 10. In an exemplary embodiment, the flanged connection 12 is part of a BOP riser or marine drilling riser, which is lowered along with the connector apparatus 10.

Before, and during at least a portion of, the lowering of the connector apparatus 10 in the ocean or sea 38, the position of the sleeve 20 shown in FIGS. 1-3 continues to be maintained by the shear elements 32*a* and 32*b*. Thus, the sealing elements 16*a* and 16*b* continue to be disposed radially between adapter 14 and the sleeve 20, with the sleeve 20 continuing to cover the sealing elements 16*a* and 16*b*. As a result, the sleeve 20 facilitates protecting the sealing elements 16*a* and 16*b* from any fluid flow through the internal passage 14*c*, including any flow of wellbore fluids or produced fluids through the internal passage 14*c*, which flow may occur during the engagement of the connector apparatus 10 with the casing 40. The sleeve 20 operates as a protective sleeve, facilitating the fluidic isolation of the sealing assembly 16 from any fluid flow through the internal passage 14*c*, including any flow of wellbore fluids or produced fluids through the internal passage 14*c*, thereby protecting the sealing assembly 16 from being damaged by any wellbore fluids or produced fluids. The sleeve 20 reduces the risk of, or potential for, damage to the sealing assembly 16, including any damage to the sealing elements 16*a* and 16*b*. By facilitating the fluidic isolation of the sealing assembly 16 from the internal passage 14*c*, the sleeve 20 allows the connector apparatus 10 to be installed over a producing well without appreciably damaging the sealing elements 16*a* and 16*b*.

The connector apparatus 10 continues to be lowered in the ocean or sea 38 and towards the casing 40 for engagement therewith. The casing 40 is received by the funnel 26, which guides the casing 40 towards the passage 22*b* of the slip bowl 22, and/or guides the lowering of the connector apparatus 10. The frusto-conical surface 22*c* further guides the casing 40, and/or the lowering of the connector apparatus 10, so that the casing 40, the passage 22*b*, and the internal passage 14*c* are all coaxial. As the connector apparatus 10 is lowered, the internal passage 14*c* receives the casing 40, with the upper end of the casing 40 passing the casing slips 24, extending within the spacer 18, and engaging the lower end of the sleeve 20.

As the connector apparatus 10 continues to be lowered, and thus installed over, the casing 40, the internal passage 14*c* continues to receive the casing 40. As a result, the upper end of the casing 40 unseats the sleeve 20, causing the shear elements 32*a* and 32*b* to shear, and the sleeve 20 to slide or move upwards in the internal passage 14*c* and relative to the adapter 14. As the sleeve 20 slides or moves upwards in the internal passage 14*c*, relative to the adapter 14, the casing 40 follows the sleeve 20 so that the sleeve 20, and/or the casing 40, cover(s) the sealing assembly 16 throughout the relative movement between the sleeve 20 and the adapter 14, continuously protecting the sealing assembly 16 from any fluid flow through the internal passage 14*c*. The casing 40 forces the sleeve 20 to move, relative to the adapter 14, within the internal passage 14*c* and away from the sealing elements 16*a* and 16*b* so that, eventually, the sleeve 20 does not cover the sealing elements 16*a* and 16*b*.

Figure 4:
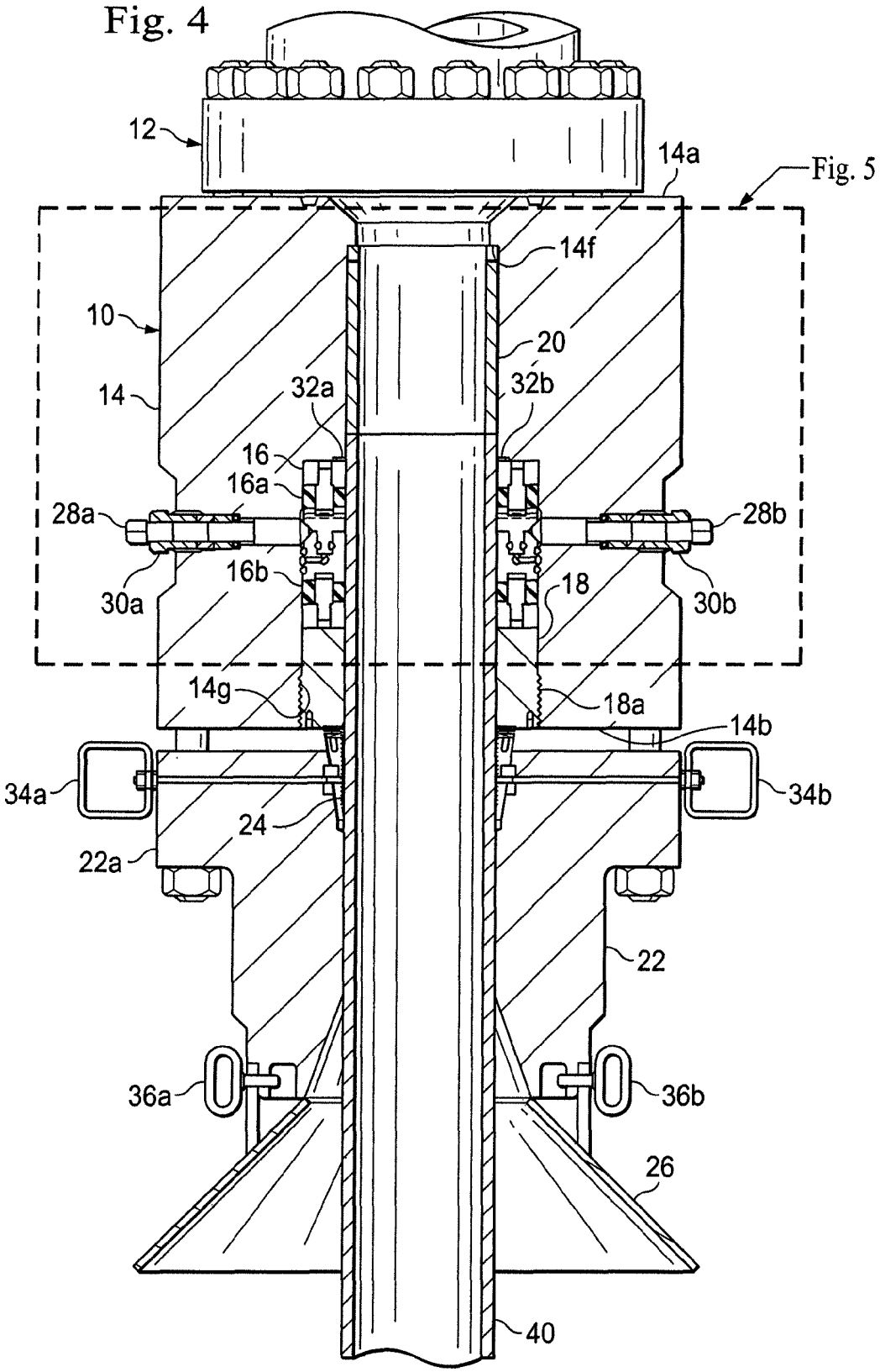
FIG. 4 is another sectional view of the engagement operation between the connector apparatus of FIGS. 1-3 and the casing of FIG. 3, according to an exemplary embodiment.
Figure 5:
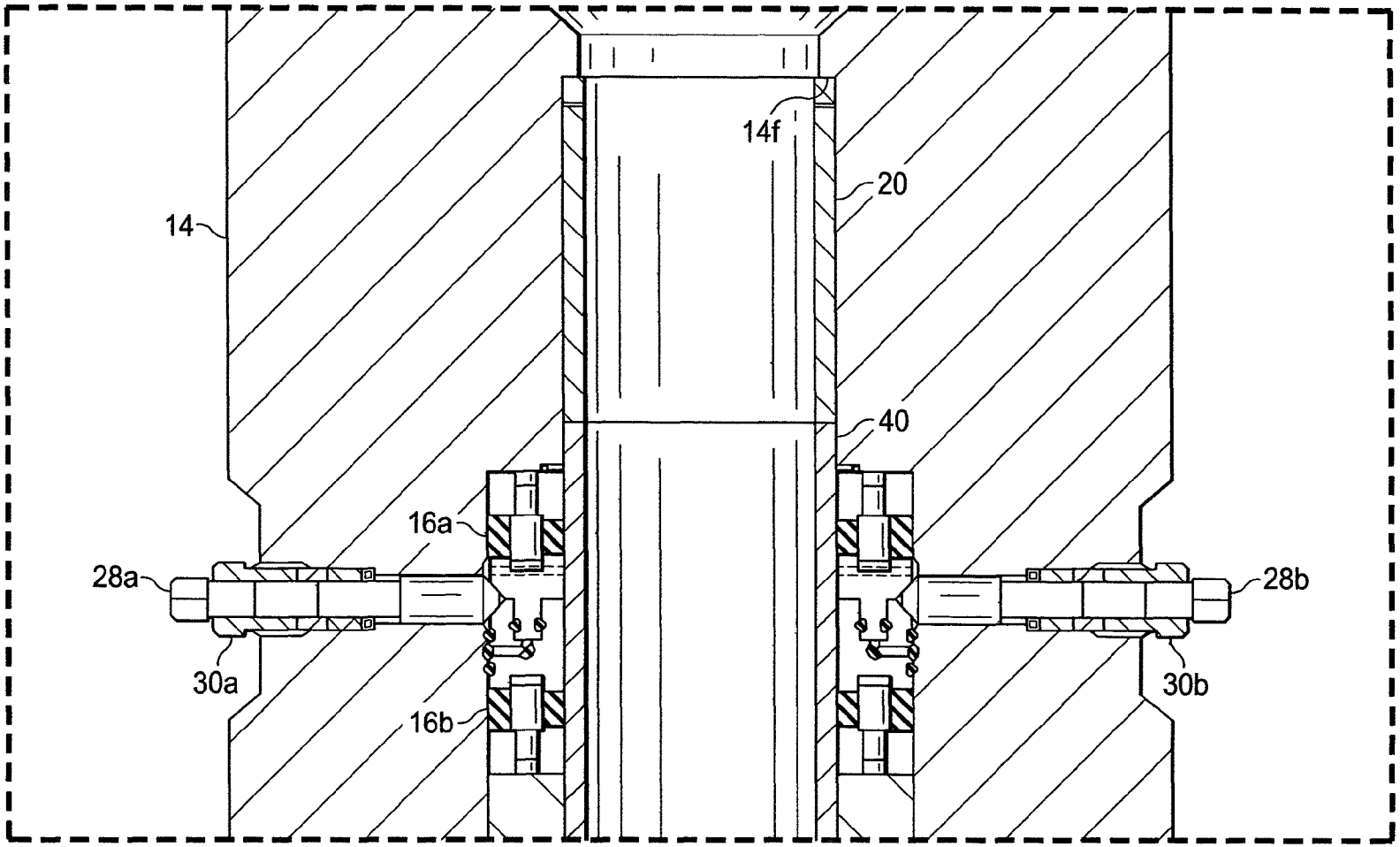
FIG. 5 is an enlarged view of a portion of FIG. 4, according to an exemplary embodiment.

In an exemplary embodiment, as illustrated in FIGS. 4 and 5 with continuing reference to FIGS. 1-3, the sleeve 20 continues to undergo upward displacement relative to the adapter 14, sliding or moving upwards in the internal passage 14*c* until the upper end of the sleeve 20 contacts the internal shoulder 14*f* of the adapter 14, at which point the sleeve 20 and the casing 40 stop moving, relative to the adapter 14. As a result, the sleeve 20 provides a positive stop for the casing 40, and the achievement of the positive stop indicates that the connector apparatus 10 is completely engaged with the casing 40.

In an exemplary embodiment, after the sleeve 20 and the casing 40 have stopped moving relative to the adapter 14, the sealing assembly 16 is disposed radially between the adapter 14 and the casing 40. Before, or after, the sleeve 20 and the casing 40 have stopped moving relative to the adapter 14, the sealing assembly 16 is energized or set so that the sealing elements 16*a* and 16*b* sealingly engage the outside surface of the casing 40. In an exemplary embodiment, the sealing elements 16*a* and 16*b* are pressure set, as well as mechanically set, so that the sealing elements 16*a* and 16*b* sealingly engage the outside surface of the casing 40. In an exemplary embodiment, to energize or set the sealing elements 16*a* and 16*b*, and/or to ensure the energizing or setting of the sealing elements 16*a* and 16*b*, the lock screws 28*a* and 28*b* are torqued to a predetermined torque level or range, and the gland nuts 30*a* and 30*b* are torqued to a predetermined torque level or range. In several exemplary embodiments, instead of, or in addition to being both pressure and mechanically set, the sealing elements 16*a* and 16*b* may be pressure set, mechanically set, interference set, or set using any combination of the foregoing. In several exemplary embodiments, as noted above, depending upon the type of sealing system selected for the sealing assembly 16, the lock screws 28*a* and 28*b* and the gland nuts 30*a* and 30*b* may be omitted.

In several exemplary embodiments, the sealing engagement between the sealing elements 16*a* and 16*b* and the casing 40 prevent, or at least reduce, the flow of fluid (including, e.g., production fluid, produced fluids, or wellbore fluid) along the outside of the sleeve 20 and/or the casing 40 and across the sealing assembly 16. In several exemplary embodiments, the sealing elements 16*a* and 16*b* may prevent, or at least reduce, such fluid flow across the sealing assembly 16 and along the outside surface of the casing 40 in a downward direction, as viewed in FIGS. 4 and 5. In several exemplary embodiments, such fluid flow may occur as a result of the operation of the subsea blowout preventer, to which the connector apparatus 10 is operably coupled.

In several exemplary embodiments, the above-described protection of the sealing elements 16*a* and 16*b*, using the sleeve 20, results in little or no damage to the sealing elements 16*a* and 16*b* during the above-described installation of the connector 10. Since the sealing elements 16*a* and 16*b* have minimal or no damage, the protection afforded by the sleeve 20 facilitates the efficacy of the sealing engagement between the sealing elements 16*a* and 16*b* and the outside surface of the casing 40.

In an exemplary embodiment, before, during or after the setting of the sealing elements 16*a* and 16*b*, the casing slips 24 engage the outside surface of the casing 40. In an exemplary embodiment, the casing slips 24 engage the outside surface of the casing 40 by mechanically gripping the outside surface of the casing 40. In an exemplary embodiment, to engage the casing slips 24 with the outside surface of the casing 40, the retention screws 34*a* and 34*b* are removed from the slip bowl 22, causing the casing slips 24 to fall down and wedge between the slip bowl 22 and the casing 40. In an exemplary embodiment, each of the casing slips 24 include teeth, which mechanically grip the outside surface of the casing 40 after the wedging of the casing slips 24 between the slip bowl 22 and the casing 40.

In an exemplary embodiment, before, during or after the setting of the sealing elements 16*a* and 16*b*, the funnel 26 may be removed from the connector apparatus 10 by removing the pins 36*a* and 36*b*. In an exemplary embodiment, the funnel 26 may include two or more sections, which together form the funnel 26, and the funnel 26 may be removed from the connector apparatus 10 by removing the sections.

In an exemplary embodiment, as shown in FIGS. 4 and 5, the inside diameter of the sleeve 20 is substantially equal to the inside diameter of the casing 40. As a result, the sleeve 20 does not create a choke point for, or does not obstruct, any fluid flow through the casing 40. In an exemplary embodiment, the inside diameter of the sleeve 20 is greater than the inside diameter of the casing 40 so that the sleeve 20 does not obstruct any fluid flow through the casing 40.

In several exemplary embodiments, as noted above, the incorporation of the sleeve 20 into the connector apparatus 10, with the sleeve 20 fluidically isolating the sealing assembly 16 during the above-described installation of the connector apparatus 10, allows the system to be installed over a producing well.

In several exemplary embodiments, as noted above, the connector apparatus 10 may be an emergency wellhead connector that is capable of engaging a subsea casing, and sealingly engaging same, before, during or after a blowout prevention operation involving a producing well. Therefore, in several exemplary embodiments, the above-described operation may be carried out before, during, or after a blowout prevention operation involved a producing well of which the subsea casing 40 may be a part. Moreover, in several exemplary embodiments, the above-described operation may be carried out in whole or in part using a remotely-operated vehicle (ROV).

Figure 6:
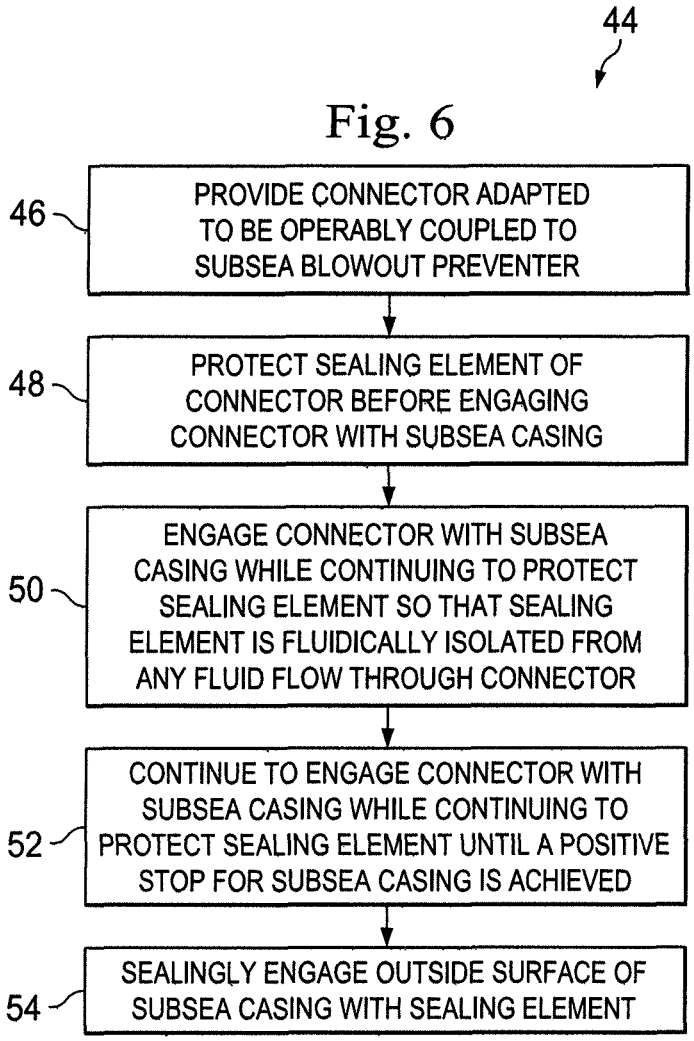
FIG. 6 is a flow chart illustration of a method of engaging the connector apparatus of FIGS. 1-5 with the casing of FIGS. 3-5, according to an exemplary embodiment.

In an exemplary embodiment, as illustrated in FIG. 6, a method is generally referred to by the reference numeral 44 and includes at step 46 providing a connector adapted to be operably coupled to a subsea blowout preventer; at step 48 protecting a sealing element of the connector before engaging the connector with a subsea casing; at step 50 engaging the connector with the subsea casing while continuing to protect the sealing element so that the sealing element is fluidically isolated from any fluid flow through the connector; at step 52 continuing to engage the connector with the subsea casing while continuing to protect the sealing element until a positive stop for the subsea casing is achieved; and at step 54 sealingly engaging the outside surface of the subsea casing with the sealing element. In an exemplary embodiment, the subsea casing is part of a producing well and thus the sealing element is fluidically isolated from any flow of wellbore fluids or produced fluids through the connector during the engagement of the connector with the subsea casing. In an exemplary embodiment, the connector apparatus includes a first tubular member that defines a first internal passage, and the step 48 includes positioning a second tubular member at a first position within the first internal passage so that the second tubular member covers the sealing element. In an exemplary embodiment, the step 50 includes effecting relative movement between the connector and the subsea casing so that the first internal passage receives the subsea casing while the first position of the second tubular member is maintained. In an exemplary embodiment, the step 52 includes continuing to receive the subsea casing within the first internal passage so that the subsea casing engages the second tubular member and forces the second tubular member to move, relative to the first tubular member, within the first internal passage and away from the sealing element so that the second tubular member does not cover the sealing element; during the relative movement between the first and second tubular members, the sealing element is covered by the second tubular member, the first tubular member, or both of the second and first tubular movements, to continue to protect the sealing element.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and "right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. An apparatus adapted to engage a subsea casing the apparatus comprising:

a first tubular member defining a first internal passage adapted to receive the subsea casing;

a counterbore formed in the interior of the first tubular member and coaxial with the first internal passage, the counterbore defining a first internal shoulder in the first tubular member;

a sealing assembly disposed in the counterbore, the sealing assembly comprising a sealing element; and a second tubular member defining a second internal passage, the second tubular member extending within the first internal passage and configured to change between;

a first axial position, relative to the first tubular member, in which the sealing element is disposed radially between the first and second tubular members, thereby protecting the sealing element from any fluid flow through the first internal passage; and a second axial position, relative to the first tubular member, in which the sealing element is not disposed radially between the first and second tubular members, thereby permitting the sealing element to sealingly engage the subsea casing after the subsea casing has been received by the first internal passage.

2. The apparatus of claim 1, wherein relative movement between the first tubular member and the second tubular member causes the second tubular member to change from the first axial position to the second axial position as the subsea casing is received by the first internal passage.

3. The apparatus of claim 1, further comprising a second internal shoulder formed in the first tubular member; and wherein, when the second tubular member is in the second axial position, the second tubular member abuts the second internal shoulder of the first tubular member.

4. The apparatus of claim 1, wherein the sealing assembly defines a first axial length; and wherein the second tubular member defines a second axial length that is equal to, or greater than, the first axial length.

5. The apparatus of claim 1, further comprising:

a shear element engaged with each of the first and second tubular members;

wherein, when the second tubular member is in the first axial position, the shear element resists relative movement between the first and second tubular members.

6. The apparatus of claim 1, wherein of the first tubular member is adapted to be connected to a subsea blowout preventer.

7. The apparatus of claim 1, further comprising:

a third tubular member connected to the first tubular member, the third tubular member defining a third internal passage that is coaxial with the first internal passage; and one or more casing slips at least partially disposed in the third internal passage.

8. The apparatus of claim 1, wherein the sealing assembly abuts the first internal shoulder of the first tubular member.

9. The apparatus of claim 8, further comprising:

a spacer disposed in the counterbore and abutting the sealing assembly;

wherein the sealing assembly is positioned axially between the spacer and the first internal shoulder of the first tubular member.

10. An apparatus adapted to engage a subsea casing, the apparatus comprising:

a first tubular member defining a first internal passage adapted to receive the subsea casing;

a second tubular member defining a second internal passage, the second tubular member extending within the first internal passage; and a sealing assembly disposed radially between the first and second tubular members, the sealing assembly comprising a sealing element;

wherein the second tubular member facilitates protecting the sealing element from any fluid flow through the first internal passage; and wherein each of the first and second tubular members is slidable, relative to the other of the first and second tubular members, so that the sealing element is not disposed radially between the first and second tubular members, thus permitting the sealing element to sealingly engage the subsea casing after the subsea casing has been received by the first internal passage.

11. The apparatus of claim 10, wherein the first tubular member is adapted to be connected to a subsea blowout preventer.

12. The apparatus of claim 10, wherein the apparatus further comprises a counterbore formed in the interior of the first tubular member and coaxial with the first internal passage, the counterbore defining a first internal shoulder in the first tubular member; and wherein the sealing assembly is disposed in the counterbore.

13. The apparatus of claim 12, further comprising:

a spacer disposed in the counterbore and abutting the sealing assembly, wherein the sealing assembly is positioned axially between the spacer and the first internal shoulder of the first tubular member.

14. The apparatus of claim 10, further comprising:

a shear element engaged with each of the first and second tubular members, wherein the shear element resists relative movement between the first and second tubular members.

15. The apparatus of claim 10, further comprising:

a third tubular member connected to the first tubular member, the third tubular member defining a third internal passage that is coaxial with the first internal passage; and one or more casing slips at least partially disposed in the third internal passage.

16. A method, comprising:

providing a connector, the connector comprising a first tubular member that defines a first internal passage adapted to receive a subsea casing, a second tubular member positioned at a first axial position within the first internal passage, and a sealing element disposed radially between the first and second tubular members;

sheathing the subsea casing with the first tubular member so that the subsea casing is received within the first internal passage while the second tubular member is maintained in the first axial position, thus protecting the sealing element from any fluid flow through the first internal passage;

moving the connector relative to the subsea casing until the second tubular member engages the subsea casing, the first tubular member is moved relative to both the second tubular member and the subsea casing, and the second tubular member is positioned at a second axial position within the first internal passage; and sealingly engaging the sealing element with the outside surface of the subsea casing.

17. The method of claim 16, wherein, during the relative movement between the first and second tubular members, the sealing element is covered by the second tubular member, the subsea casing, or both of the second tubular member and the subsea casing, to continue to protect the sealing element.

18. The method of claim 16, wherein the subsea casing is part of a producing well and thus the sealing element is protected from any flow of wellbore fluids or produced fluids through the connector during the engagement of the connector with the subsea casing.

* * * * *